US007373994B2

(12) United States Patent
Tchakarov et al.

(10) Patent No.: US 7,373,994 B2
(45) Date of Patent: May 20, 2008

(54) SELF CLEANING CORING BIT

(75) Inventors: Borislav J. Tchakarov, Humble, TX (US); Roderick A. Larson, Kingwood, TX (US); David W. Ashcraft, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 243 days.

(21) Appl. No.: 10/960,471

(22) Filed: Oct. 7, 2004

(65) Prior Publication Data

US 2006/0076162 A1 Apr. 13, 2006

(51) Int. Cl.
*E21B 49/06* (2006.01)
*E21B 10/02* (2006.01)

(52) U.S. Cl. ..... 175/58; 175/77; 175/393; 175/403

(58) Field of Classification Search ..... 175/403, 175/405.1, 393, 58, 77
See application file for complete search history.

(56) References Cited

U.S. PATENT DOCUMENTS 231,785 A * 8/1880 Fleming ..... 175/395
2,032,509 A * 3/1936 Shanor ..... 175/78
2,838,286 A * 6/1958 Austin ..... 175/405.1
3,331,455 A * 7/1967 Anderson, Jr. et al. ..... 175/403
4,657,441 A * 4/1987 Horvath ..... 405/254
4,915,182 A * 4/1990 Magyari et al. ..... 175/403
5,687,806 A 11/1997 Sallwasser et al.
6,167,968 B1 1/2001 Allarie et al.
6,189,629 B1 2/2001 McLeod et al.
6,578,636 B2 6/2003 Mazorow et al.

* cited by examiner

*Primary Examiner*—Hoang Dang
(74) *Attorney, Agent, or Firm*—Bracewell & Giuliani LLP

(57) ABSTRACT

A coring member useful in wellbore excavating operations comprising at least one segment disposed onto the end of a shaft, where a channel is formed between each at least one segment. The at least one segment has an impeller like arrangement that on rotation produces a pressure differential across the face of the coring member. The impeller like arrangement comprises an obliquely attached vane on one side of the face, and an obliquely attached rib on the other side. Rotation of the coring member within a fluid produces a localized high-pressure zone adjacent the face of each rib and a corresponding low-pressure zone adjacent the face of each vane. Each channel provides fluid communication between a vane and a rib, where the vane and the rib are located on different but adjacent segments. The pressure differential between the vane and the rib during rotation of the drill bit within a fluid can produce fluid flow through the channel from the rib to the vane.

29 Claims, 3 Drawing Sheets

SELF CLEANING CORING BIT

BACKGROUND OF THE INVENTION

1. Field of the Invention

The invention relates generally to the field of excavating of wellbores. More specifically, the present invention relates to an apparatus and method for inducing fluid circulation over an excavation bit. Yet more specifically, the present invention further relates to inducing fluid circulation over a circulation bit during side bore excavating.

2. Description of Related Art

In excavating or operations within a wellbore 5, drill bits are often used in the drilling or coring of a wellbore 5 that extends from the earth's surface into and through a subterranean formation 8. The drilling involved includes the drilling of a standard vertical wellbore 5, slanted or deviated wellbores (not shown), as well as lateral wellbores 6 that extend at a substantially perpendicular direction from a primary wellbore 5. These are standard drilling operations and they involve circulation of drilling fluid through a drill string (or drill pipe) from the surface above the wellbore 5.

Generally, when forming lateral wellbores 6 a coring tool 10 may be used as shown in FIG. 1. Coring tools 10 are deployed in a wellbore generally on a logging cable and in some cases on tubing or drill pipe, but even then fluid circulation from the surface to the coring tool 10 is not possible. The coring tools 10 comprise means for urging a coring bit 26 against the inner wall of a wellbore 5 for drilling a lateral wellbore 6—where the coring bit 26 is disposed on the end of a drill shaft 23. A driver 20 can be attached to the coring drill 22 as a drive source to the drill shaft 23 thereby providing a rotational force to the coring bit 26 for drilling into the formation 8 around the wellbore 5. The driver 20 can be powered by hydraulic fluid provided within a hydraulic feed line 18, or other mechanical means. Push rods 12, working in combination with associated piston heads 14 disposed within a cylinder 16 can provide the lateral force necessary for urging the coring drill 22 into the formation 8.

During most vertical excavating operations a fluid is generally supplied to the drill bit for cooling and lubricating the drill bit and to wash away debris accumulated during excavating within a wellbore. Once the fluid passes through the cutting zone it generally flows to the surface for treatment where it can be filtered and possibly refurbished. As is well known, the fluid supplied to the bit is typically a drilling fluid that is supplied under high pressure. The drilling fluid must be supplied at high pressure to overcome the local high pressure within the wellbore as well as to have sufficient velocity for removing the debris away from the bit. This debris, which includes shards of rock and other material cut from the formation, as well as broken pieces of the drill bit or coring device, remains between the face of the drill bit and the formation and can greatly hinder the ability of further excavating through the formation.

Ports and fluid nozzles (not shown) generally are provided at the drill bit for directing the drilling fluid for directing the drilling fluid from the drill bit into the cutting zone. Various drilling fluid flow paths are utilized depending on the composition of the earth formation being drilled. Most drill bits include downwardly directed nozzles for flushing and removing the formation cuttings from the bottom of the well hole. Some drill bits include nozzles that direct drilling fluid on the cutting elements to prevent clogging of the cutting elements in earth formations.

While fluids have been successfully implemented in typical vertical drilling operations, when coring operations are performed, fluids have not been supplied to the face of the drill bit of a coring drill 22. Accordingly, in the absence of a cleaning and lubricating fluid, coring operations are often severely hindered by an accumulation of formation shards and other debris collecting at the face of the coring drill 22. Therefore a need exists for a device and method of providing fluids to the bit of a coring drill 22 during use.

Pumps (not shown) are used in pressurizing the drilling fluid and delivering the pressurized fluid to the drill bit. The pressurized fluid can flow from the pump discharge to the bit through a drill string or other tubular member. When the coring tool 10 is lowered on a cable or wireline, it is technologically extremely complicated and economically not feasible to create fluid circulation involving pumps as part of the tool. Therefore, a true advantage over prior art devices exists in an apparatus capable of inducing fluid flow in the cutting zone that exists between a drill bit and the subterranean formation where excavation is being conducted.

BRIEF SUMMARY OF THE INVENTION

The present invention includes a coring bit comprising a cutting member, at least one channel having a first end and a second end, where the at least one channel is disposed along the cutting member. The present invention further includes a means for inducing a pressure differential along the channel upon rotation of said coring bit. The coring bit can include at least one vane capable of producing a low-pressure zone upon rotation of the coring bit, and can also include at least one rib capable of producing a high-pressure zone upon rotation of the coring bit. The combination of the low-pressure producing rib with the high-pressure producing vane provides for the ability to cause fluid to flow over the face of the coring bit. The at least one vane should be disposed proximate to one end of the channel and the at least one rib should be disposed at the other end of the channel. The coring bit can be comprised of two or more coring bit faces such that the at least one channel resides between each of the two or more coring bit faces.

The coring bit of the present invention can further comprise a shaft connectable to the coring bit and at least one port radially formed through the wall of the shaft. Upon rotation of the coring bit within a fluid, the pressure differential produced by the rotation causes the fluid to flow through the channel. An axis is included that is substantially perpendicular to the cutting member, wherein a portion of the vane is disposed at an angle from approximately 30 degrees to approximately 60 degrees with respect to the axis. Further, a portion of the vane can be disposed at an angle that is approximately 45 degrees with respect to the axis. Additionally, a portion of the rib can be disposed at an angle from approximately 30 degrees to approximately 60 degrees with respect to the axis. Alternatively, a portion of said rib can be disposed at an angle that is approximately 45 degrees with respect to the axis.

The present invention includes a coring bit comprising, a cutting member having an outer periphery and an inner periphery, at least one vane disposed proximate to the outer periphery of the at least one cutting member, at least one rib disposed proximate to the inner periphery of the at least one cutting member, and at least one channel providing fluid communication between the at least one vane and the at least one rib. The at least one rib of this embodiment can be angled from about 30 degrees to about 60 degrees with respect to the axis of the cutting member. Optionally, the at least one rib of this embodiment can be angled at about 45 degrees with respect to the axis of said cutting member. Furthermore, the at least one vane of this embodiment can be angled from about 30 degrees to about 60 degrees with respect to the axis of the cutting member. Also, the at least one vane can be angled at about 45 degrees with respect to the axis of the cutting member.

The present invention include a method of coring within a borehole without forced circulation comprising, urging a coring bit against the formation surrounding a borehole, and inducing circulation across the face of the bit using the bit's shape. The coring bit has an impeller like attachment capable of reducing the pressure within the cutting zone proximate to the coring bit upon its rotation. Rotating the coring bit within the borehole reduces the pressure within a zone adjacent to the impeller like attachment and induces a pressure differential across the coring bit. The coring bit should be at least partially submerged in fluid. The pressure differential induced across the coring bit produces the fluid to flow over the face of said coring bit. The fluid flowing over the face of the coring bit is capable of washing formation cuttings away from the face.

DETAILED DESCRIPTION OF THE INVENTION

The present invention provides an enhanced manner of circulating fluid across a coring tool for lubrication during coring and to wash away the cuttings produced during coring. The present invention induces a pressure differential across the coring bit of the coring tool that in turn can produce fluid circulation across the coring bit. As will be explained in further detail below, the present invention employs a coring bit whose unique structure produces the aforementioned pressure differential during rotation of the coring bit.

Figure 2:
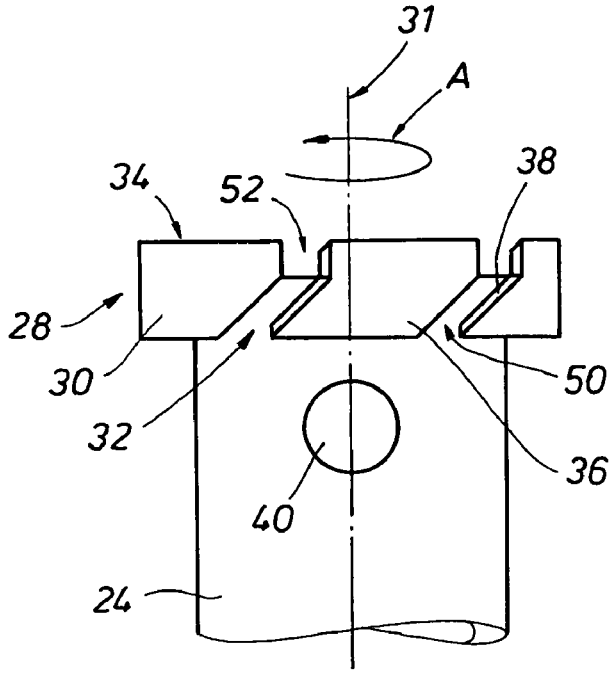
FIG. 2 illustrates a side view of a shaft having an embodiment of the coring bit of the present invention secured thereon.

With reference now to the drawings herein, one embodiment of a coring bit 28 of the present invention is illustrated in a side view in FIG. 2. The coring bit 28 is comprised of a coring member having at least one segment 30, and preferably a number of segments 30, disposed on the end of a coring shaft 24. The segments 30 can be comprised of surface mounted diamonds, diamond impregnated cutters, polycrystalline diamond compact (PDC) cutters, or tungsten carbide cutters. Preferably each segment 30 is substantially the same size and configuration. Furthermore, it is also preferred that the segments 30 are symmetrically disposed on the end of the coring shaft 24 with spaces provided between each segment 30, where each of said spaces are also preferably substantially the same size and configuration. These spaces constitute channels 32 extending along the entire length of the sides of each of the segments 30.

Figure 3A:
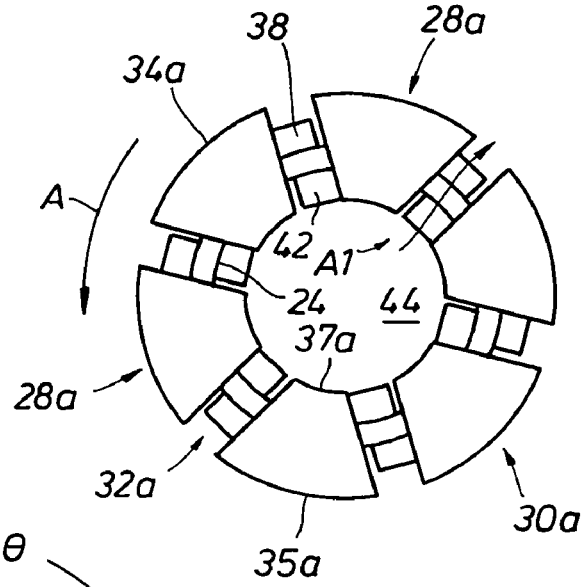
FIG. 3*a* portrays an overhead view of an embodiment of the coring bit of the present invention.
Figure 3B:
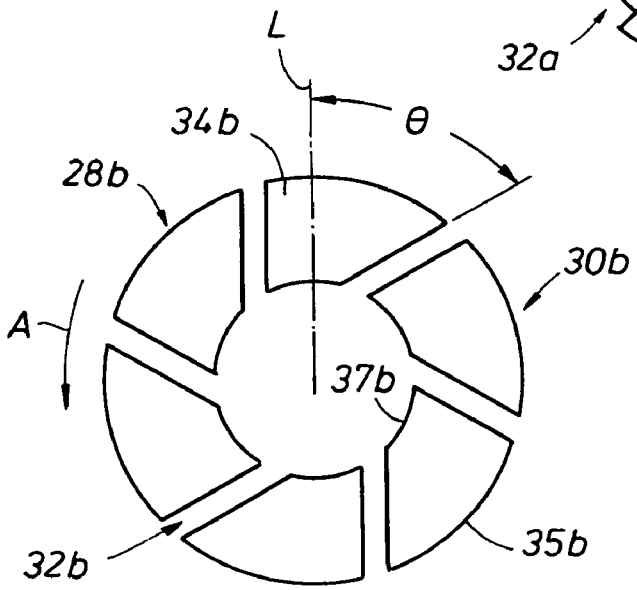
FIG. 3*b* illustrates an overhead view of an embodiment of the coring bit of the present invention.

Each segment 30 comprises a face 34, a skirt potion 36, and a rib 42. The face 34 of each segment 30 comprises its uppermost surface and has a generally wedge-like shape. The outermost periphery 35 of each face 34 is convexly curved such that when the coring bit 28 comprises multiple segments 30 the profile of the curved outermost periphery 35 of the segments 30 gives the coring bit 28 a generally circular configuration. Similarly, the innermost periphery 37 of the segments 30 is concavely curved thereby forming a circular opening 44 centered through the coring bit 28. As shown in FIGS. 3*a* and 3*b*, when the coring bit (28*a*, 28*b*) is viewed from above, the channels (32*a*, 32*b*) extend perpendicularly between the outermost periphery (35*a*, 35*b*) of each segment (30*a*, 30*b*) and its innermost periphery (37*a*, 37*b*).

The embodiment of FIG. 3*a* illustrates a series of segments 30*a* separated by channels 32*a* that extend generally radially from the center of the coring bit face 34*a*. In the embodiment of FIG. 3*b*, the channels 32*b* are disposed at an angle θ relative to a line L radially extending from the center of the coring bit face 34*b*. Preferably θ is approximately 45°, but can range from below 30° to in excess of 60°. As will be explained in further detail below, angling the channels 32*b* can provide a turbine effect on the coring bit 28*b*.

Since the surface of the face 34 is used in cutting into the formation surrounding a wellbore, it preferably includes raised portions on its surface for boring into the formation during coring operations. The raised portions can include teeth, diamonds, or any other currently known or later developed protruding like members. Such as surface mounted diamonds, diamond impregnated cutters, polycrystalline diamond compact (PDC) cutters, or tungsten carbide cutters. Additionally, the diamonds can be impregnated onto the surface of the face 34 for enhanced stability of the cutting force of the diamonds and enhancing the cutting life of the coring bit 28.

Figure 4:
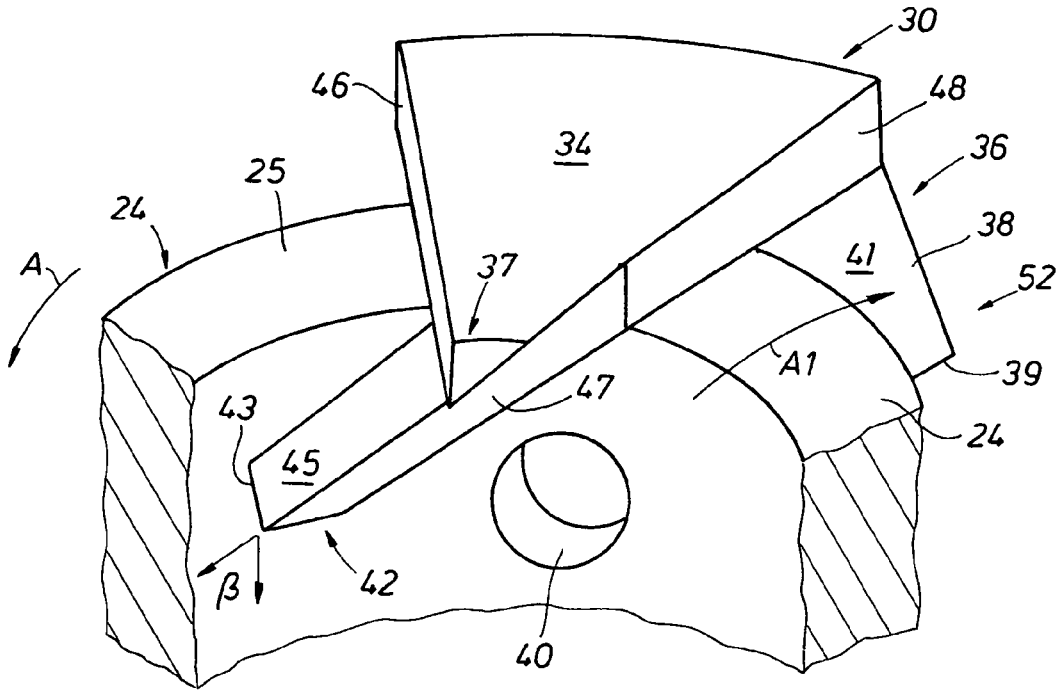
FIG. 4 depicts a perspective view of a segment of an embodiment of the coring bit of the present invention.

In the embodiment of the invention of FIG. 4, a perspective view of a single segment 30 is shown looking outward from the opening 44 of the coring bit 28. Here a rib 42 is shown extending from the innermost periphery 37 of the face 34 at an angle oblique to the face 34 and adjacent to the inner diameter of the coring shaft 24. As shown, the rib 42 has a triangular cross section. The thickness of the rib 42 diminishes proximate to its leading edge 43 such that at the leading edge 43 the thickness is substantially smaller than the width.

While alternative embodiments of the rib 42 can include a multitude of other cross sectional configurations, the rib 42 should have an upper surface 45 that is planar and also largely perpendicular to the inner diameter of the coring shaft 24. The lower surface 47 of the rib 42 extends from the inner diameter of the coring shaft 24 and terminates along the outer edge of the upper surface 45. The angle between the lower surface 47 and the inner diameter of the coring shaft 24 is preferably greater than 90°. Here the rib 42 is shown positioned at an angle β with respect to the axis 31 of the coring shaft 24. Preferably β is approximately 45°, but can range from below 30° to in excess of 60°.

Figure 5:
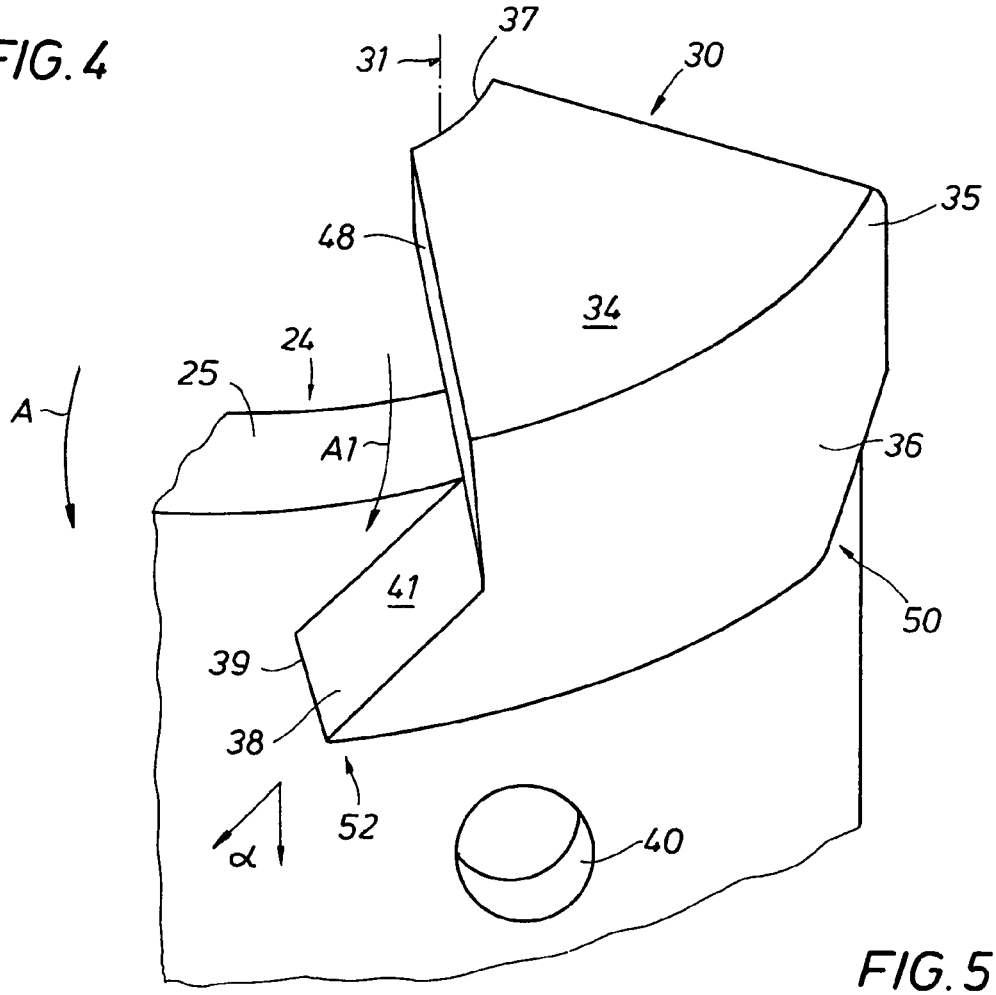
FIG. 5 depicts a perspective view of a segment of an embodiment of the coring bit of the present invention.

With reference now to FIG. 5, a perspective view of an embodiment of the invention is shown illustrating a skirt 36 perpendicularly extending downward from the outermost periphery 35 of the face 34 along the outer radius of the coring shaft 24. When viewed from the side, as seen in FIG. 2, both the skirt front 50 and skirt rear 52 are comprised of a planar surface that is perpendicular to the outer wall of the coring shaft 24. Further, the skirt front 50 and skirt rear 52 are parallel to the axis 31 of the coring shaft 24 along a portion of their respective lengths and oblique to the axis 31 of the coring shaft 24 along the remaining portion of their lengths. Preferably the front and rear portions of the skirt (50, 52) of each segment 30 run parallel to one another such that when the coring bit 28 comprises multiple segments 30 the distance between adjoining segments 30 is constant along the entire length of the respective skirts 36, irrespective of the angle of the front or rear portion (50, 52) of the particular skirt 36. Accordingly, the channels 32 separating the segments 30 should have a correspondingly constant width along their entire length. Thus in one exemplary embodiment, when viewed from the outer diameter, the inner diameter, and the top of the coring bit 28, the channels 32 each have an outer periphery that substantially resembles that of a parallelogram.

A vane 38 is shown in FIG. 5 formed on the skirt rear 52 extending at an angle oblique from the face 34. Like the rib 42, the vane 38 has a cross section that is largely rectangular and terminates in a leading edge 39; where the thickness of the leading edge 39 is substantially smaller than its width. Also similar to the rib 42, the cross section of the vane 38 can be something other than rectangular, however the upper surface 41 of the vane 38 should be largely planar and perpendicular to the outer diameter of the coring shaft 24. Further, the upper surface 41 of the vane 38 lies at an angle $\alpha$ with respect to the axis 31 of the coring shaft 24. Preferably a is approximately 45°, but can range from below 30° to in excess of 60°.

Figure 1:
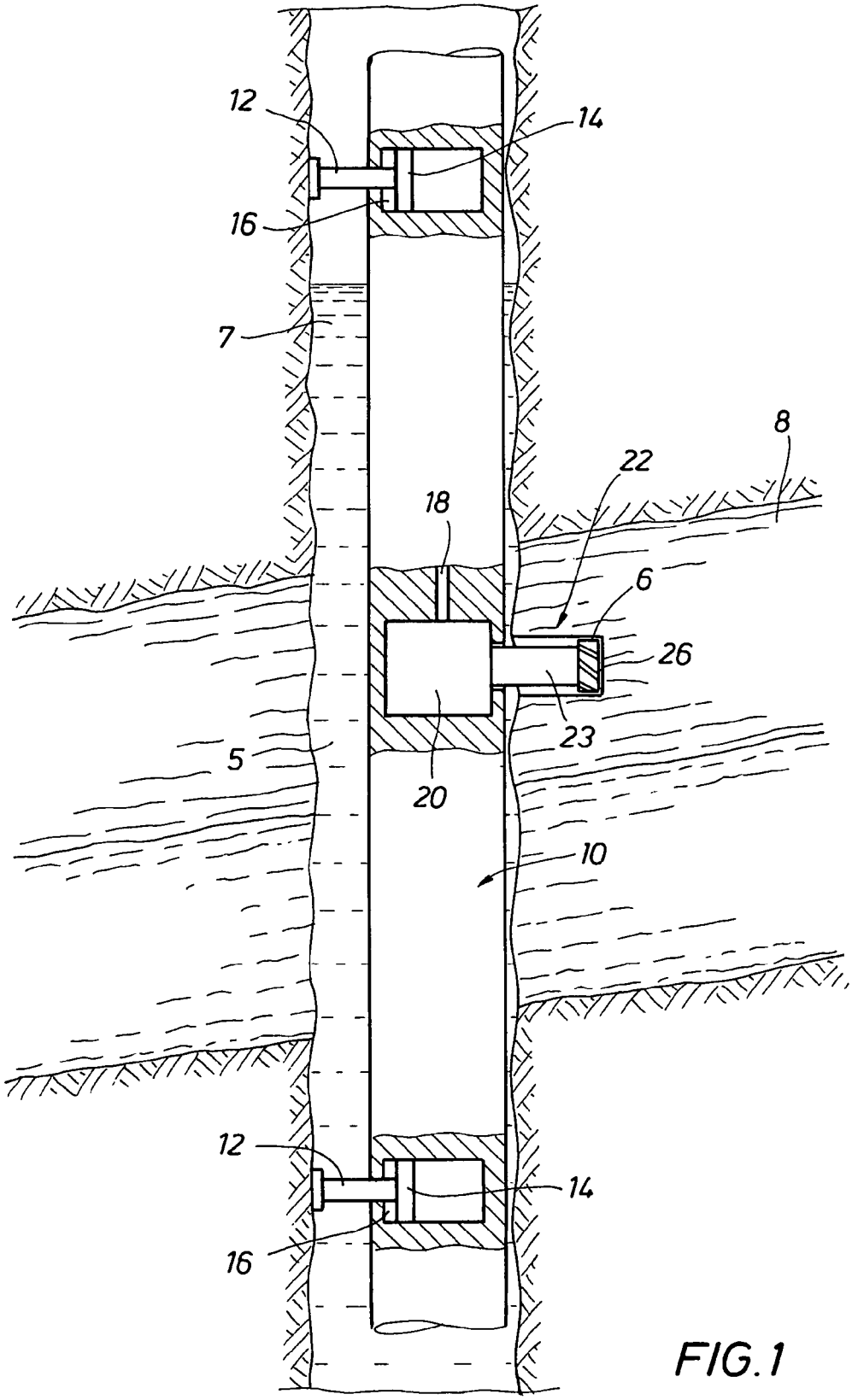
FIG. 1 depicts a side view of a coring tool disposed within a wellbore.

In use, the coring bit 28 of the present invention is rotatingly directed at the location within the wellbore 5 such that the face 34 of each at least one segment 30 is urged into cutting contact with the formation surrounding the wellbore 5. The coring bit 28 can be directed lateral to the primary wellbore 5, as shown in FIG. 1, or it can also be directed parallel to the primary wellbore 5.

While in operation, the coring bit 28 should be rotated in the direction of the arrow A, thus the rib 42 will be in a leading position during rotation and the vane 38 will be in a trailing position. As previously pointed out, during coring operations the coring bit 28 is typically submerged in wellbore fluid 7. During rotation of the coring bit 28 within the wellbore fluid 7, the leading edge configuration of the rib 42 impinges a portion of the wellbore fluid 7 on its upper surface 45. This impingement causes a localized pressure increase in the wellbore fluid 7 along the upper surface 45 and in the area of the forward edge 46 of the segment 30 proximate to where it joins the upper surface 45.

With regard now to the vane 38 during operation of the coring bit 28, the slant angle $\alpha$ of the upper surface 41 of the vane 38 ranges from 30° to 60° with respect to the axis 31 of the coring shaft 24. During rotation of the coring bit 28, this angle produces a localized low-pressure zone in the region of the wellbore fluid 7 proximate to the upper surface 41 of the vane 38. The combination of the localized high pressure zone of wellbore fluid 7 proximate to the rib 42 and the localized low-pressure region of wellbore fluid 7 proximate to the vane 38 creates a pressure imbalance within each specific channel 32. This pressure imbalance in turn causes the flow of wellbore fluid 7 through each channel 32 from the rib 42 on the inner diameter of the coring shaft 24, over the edge 25 of the coring shaft 24, and onto the upper surface 41 of the vane 38.

Optionally, replacement wellbore fluid 7 can flow from the outer diameter of the coring shaft 24 though the port 40 to the inner diameter of the coring shaft 24. The port 40 provides a fluid flow path between the inner and outer diameter of the coring shaft 24. While the port 40 is shown as a radial aperture, it can be of any other shape, such as rectangular, a series of slits, oval, elliptical, or any shape that allows for such flow through the coring shaft 24.

The direction of the flow of the wellbore fluid 7 through the channel 32 is shown by arrow Al. The cuttings (not shown) generated while coring can accumulate in the portion of the channels 32 running between the faces 34 of the segments 30. As the wellbore fluid 7 passes over the edge 25 of the shaft 24 it irrigates the portion of the channel 32 located between the forward edge 46 and the rearward edge 48 of adjacent segments 30 thereby clearing the cuttings that may have accumulated in this cavity. The cuttings are carried with the wellbore fluid 7 past the upper surface 41 of the vane 38 and into the open space outside of the outer diameter of the coring shaft 24. Thus the fluid flow over the coring bit 28 of the present invention is accomplished by inducing flow and therefore does not require the need for forced circulation of fluid.

Washing away the cuttings present in the channel 32 allows the cuttings lodged between the face 34 and the formation to now pass into the channel 32. As is known, removing the cuttings from face 34 of the coring bit 28 greatly enhances the cutting ability and effectiveness of the overall coring operation. For the sake of clarity, it should be pointed out that the pressure differential causing the above described flow of wellbore fluid 7 through the channel 32 is caused by a rib 42 on one segment 30 working in conjunction with a vane 38 of a different segment 30. More specifically, the vane 38 will be on a segment 30 that is forward of the segment 30 of the rib 42 during rotation.

With regard to the embodiment of FIG. 3*b*, as noted above the channels 32*b* extend in a sweptback direction angling away from the rotational direction A of the coring bit 28*b*. During rotation of the coring bit 28*b* of FIG. 3, its sweptback arrangement produces a localized low-pressure zone in the region where the channel 32*b* meets the outer periphery 35*b*. The turbine-like arrangement of the segments 30*a* results in the capability of producing a low-pressure zone of lower pressure than that of the arrangement of FIG. 3*a*.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the present invention can be used in combination with a coring bit having forced fluid flow in addition to the induced fluid flow hereinbefore described. This and other similar modifications will readily suggest themselves to those skilled in the art, and are intended to be encompassed within the spirit of the present invention disclosed herein and the scope of the appended claims.

What is claimed is:

1. A coring bit comprising:

an annular coring shaft;

a cutting member comprising segments on an end of the coring shaft that extend along the inner and outer surface of the shaft; and channels having a first end and a second end extending between said segments along the inner surface of the shaft, the end of the shaft, and the outer surface of the shaft, wherein the channels on the inner surface of the shaft are at an angle with respect to the shaft axis wherein rotating the coring bit in a static body of fluid induces a pressure differential within said channel when the coring bit rotates in the direction of the angle of the channels on the inner surface.

2. The coring bit of claim 1, further comprising at least one vane formed on a segment on the outer surface of the shaft capable of producing a low-pressure zone upon rotation of said coring bit.

3. The coring bit of claim 2, further comprising at least one rib formed on a segment on the inner surface of the shaft capable of producing a high-pressure zone upon rotation of said coring bit.

4. The coring bit of claim 3, wherein said at least one vane is disposed proximate to one end of said channel and said at least one rib is disposed at the other end of said channel.

5. The coring bit of claim 4, comprising two or more coring bit faces, wherein said at least one channel resides between each of said two or more coring bit faces.

6. The coring bit of claim 1, further comprising port radially formed through the wall of the shaft.

7. The coring bit of claim 1, wherein upon rotation of said coring bit within a static fluid, said pressure differential causes the fluid to flow through said channel.

8. The coring bit of claim 2, further comprising a rib and an axis, wherein said axis is substantially perpendicular to said cutting member, wherein a portion of said vane is disposed at an angle from approximately 30 degrees to approximately 60 degrees with respect to said axis and wherein a portion of said rib is disposed at an angle from approximately 30 degrees to approximately 60 degrees with respect to said axis and wherein said rib and said vane are oriented in opposite directions.

9. The coring bit of claim 2, further comprising an axis substantially perpendicular to said cutting member, wherein a portion of said vane is disposed at an angle approximately 45 degrees with respect to said axis.

10. The coring bit of claim 3, further comprising an axis substantially perpendicular to said cutting member, wherein a portion of said rib is disposed at an angle approximately 45 degrees with respect to said axis.

11. The coring bit of claim 1, wherein said channel is configurable for bi-directional flow through said channel.

12. The coring bit of claim 1, wherein said means induces an irrigating flow for cleaning cutting debris from within the channel.

13. A coring bit comprising:

a cutting member having a first periphery and a second periphery;

the cutting member having at least one vane disposed proximate to its outer periphery;

the cutting member having at least one rib disposed proximate to its inner periphery; and the cutting member having at least one channel providing fluid communication between said at least one vane and said at least one rib, wherein said rib is angled with respect to the axis of the coring bit, such that rotating the coring bit in the direction of the angle of the rib creates a pressure differential that induces an irrigating flow across said channel upon rotation of the coring bit.

14. The coring bit of claim 13 wherein said at least one rib is angled from about 30° to about 60° with respect to the axis of said cutting member and wherein said at least one vane is angled from about 30° to about 60° with respect to the axis of said cutting member.

15. The coring bit of claim 13 wherein said at least one rib is angled at about 45° with respect to the axis of said cutting member.

16. The coring bit of claim 13 wherein said at least one vane is angled at about 45° with respect to the axis of said cutting member.

17. The coring bit of claim 13 further comprising a shaft coupled to a drive source.

18. The coring bit of claim 17, further comprising a port formed in said shaft.

19. The coring bit of claim 13, wherein said channel forms a parallelogram like projection in the region proximate to said at least one vane.

20. The coring bit of claim 13, wherein said channel forms a parallelogram like projection in the region proximate to said at least one rib.

21. The coring bit of claim 13, wherein said channel forms a parallelogram like projection in the region proximate to the upper surface of said cutting member.

22. The coring bit of claim 13, wherein said first periphery and said second periphery define an annular configuration and wherein a pressure differential exists across the opposite ends of the annular configuration.

23. A method of coring within a borehole comprising:

urging a coring bit against the formation surrounding a borehole, wherein the coring bit comprises a shaft having segments on an end of the shaft and channels formed between adjacent segments extending from the inside surface, across the bit face, and to the outer shaft surface, wherein the channel on the inner surface is angled with respect to the shaft axis; and rotating the bit in the direction of the channel angle thereby inducing circulation across the face of the bit.

24. The method of claim 23, wherein said coring bit has an impeller like attachment, wherein said impeller like attachment is capable of reducing the pressure within the cutting zone proximate to said coring bit upon rotation of said coring bit.

25. The method of claim 23, wherein rotating said coring bit within the borehole reduces the pressure within a zone adjacent to said impeller like attachment and induces a pressure differential across said coring bit.

26. The method of claim 23, wherein said coring bit is at least partially submerged in fluid.

27. The method of claim 26, wherein said pressure differential induced across said coring bit produces the fluid to flow over the face of said coring bit.

28. The method of claim 23, wherein the fluid flowing over the face of said coring bit is capable of washing formation cuttings away from said face.

29. The method of claim 23 wherein the step of inducing circulation creates an irrigating flow across the bit face for cleaning debris from the face.

* * * * *